US007870623B2

(12) United States Patent
Judd

(10) Patent No.: US 7,870,623 B2
(45) Date of Patent: Jan. 18, 2011

(54) WEIGHTED ARTICLE

(76) Inventor: Erin M. Judd, 8722 47th St. SW., Howard Lake, MN (US) 55349

( * ) Notice: Subject to any disclaimer, the term of this patent is extended or adjusted under 35 U.S.C. 154(b) by 460 days.

(21) Appl. No.: 11/875,562

(22) Filed: Oct. 19, 2007

(65) Prior Publication Data

US 2009/0100568 A1 Apr. 23, 2009

(51) Int. Cl.
*A47G 9/02* (2006.01)

(52) U.S. Cl. ..... 5/502; 5/486; 5/655.4

(58) Field of Classification Search ..... 428/74, 428/76, 102; 5/502, 907, 655.4, 702, 483, 5/486, 948, 954; 112/420, 421, 440
See application file for complete search history.

(56) References Cited

U.S. PATENT DOCUMENTS

| | | | | |
|---|---|---|---|---|
| 429,894 | A * | 6/1890 | Doremus | 5/502 |
| 2,217,621 | A * | 10/1940 | Katzner | 5/502 |
| 2,596,547 | A * | 5/1952 | Guest | 5/502 |
| 3,960,193 | A | 6/1976 | Davis | |
| 4,250,172 | A * | 2/1981 | Mutzenberg et al. | 442/6 |
| 4,658,442 | A | 4/1987 | Tomlinson et al. | |
| 4,689,844 | A * | 9/1987 | Alivizatos | 5/702 |
| 5,408,712 | A | 4/1995 | Brun | |
| 5,465,458 | A | 11/1995 | Schlager | |
| 5,570,474 | A | 11/1996 | Berry et al. | |
| 5,706,535 | A * | 1/1998 | Takashima | 5/485 |
| 5,720,058 | A | 2/1998 | Hollander et al. | |
| 5,810,699 | A | 9/1998 | Nadeau | |
| 5,943,700 | A | 8/1999 | Hammer et al. | |
| 6,115,859 | A * | 9/2000 | Ozawa | 5/690 |
| 6,618,881 | B2 * | 9/2003 | Hart et al. | 5/502 |
| 6,665,879 | B2 | 12/2003 | VandenBerg | |
| 2003/0233706 | A1 | 12/2003 | Birch | |
| 2004/0031099 | A1 | 2/2004 | Mastandrea, Jr. | |
| 2006/0016005 | A1 | 1/2006 | Roda | |
| 2006/0174410 | A1 * | 8/2006 | Mastandrea, Jr. | 5/482 |
| 2007/0028382 | A1 | 2/2007 | Field et al. | |
| 2008/0039913 | A1 * | 2/2008 | Mizrahi | 607/114 |

OTHER PUBLICATIONS

Abilitations, Weighted Vest for Children with Dysfunction of Sensory Integration (DSI) such as ADD, ADHD, Hyperactivity, or Autism: Why Use a Vest, copyright Jul. 2003, 2 pages.
Abilitations, Weighted Vest for Children with Dysfunction of Sensory Integration (DSI) such as ADD, ADHD, Hyperactivity, or Autism: Sewing Pattern, copyright Jul. 2003, 3 pages.
Abilitations, Weighted Vest for Children with Dysfunction of Sensory Integration (DSI) such as ADD, ADHD, Hyperactivity, or Autism: Ready-to-Wear, copyright Jul. 2003, 2 pages.

(Continued)

*Primary Examiner*—Michael Trettel
(74) *Attorney, Agent, or Firm*—Merchant & Gould P.C.

(57) ABSTRACT

A weighted article for providing deep pressure therapy includes a plurality of patchwork pieces including a plurality of layers. At least some of the patchwork pieces include a filler of weighted material contained between at least two of the plurality of layers. The plurality of patchwork pieces are fastened together at edges.

24 Claims, 11 Drawing Sheets

OTHER PUBLICATIONS

Abilitations, School Specialty US Mall, dated Jul. 1, 2007, 4 pages.
Calm Comforts, Weighted Vest, Lap Quilts and Weighted Blanket for Autism Therapy, Weighted Vests Lap Quilts and Blankets Provide a Calming Effect for Individuals with Sensory Processing Difficulties, and Increase Ability to Focus on Tasks, dated Jul. 1, 2007, 2 pages.
Calm Comforts, Weighted Vest and Blankets, Calm Comforts Products are Designed for Use by Individuals with Autism, ADHD, or Sensory Processing Difficulties, Jul. 1, 2007, 4 pages.
Calm Comforts, Calm Comforts Weighted Vest and Blankets, Calm Comforts Products are Designed for Use by Individuals with Autism, ADHD, or Sensory Processing Dificulties, dated Jul. 1, 2007, 2 pages.
Chamber, Heather, Weighted Quilts Help Autistic Kids Focus, dated Jul. 1, 2007, 2 pages.
Dream Catcher Blankets™, Quality Weighted Blanket, Weighted Blankets, Weighted Products, Blankets, Weighted, Specializing in Custom & Pre-Made Weighted Blankets and Lap Pads, copyright Jun. 2004, 12 pages.
Dream Catcher Blankets™, Quality Weighted Blanket, Weighted Blankets, Weighted Products, Blankets, Weighted, Frequently Asked Weighted Blankets Questions, copyright Jun. 2004, 4 pages.
Dream Catcher Blankets™, What is the Right Weight and Size Weighted Blanket for You, copyright 2006, 6 pages.
Fabrics, Solid Vests, dated Jul. 1, 2007, 1 page.
Inform IDSC Newsletter Winter/Spring 2003, Featuring Austism and Asperger Syndrome, 3 pages.
Mettinen, Minna, Instructions to Make a Weithed Blanket, dated Jul. 1, 2007, 1 page.
Quiet Quilt, Special Weighted Quilts for Special Kids, dated Jul. 1, 2007, 2 pages.
Quiet Quilt, Special Weighted Quilts for Special Kids; Specifications, dated Jul. 1, 2007, 2 pages.
Quiet Quilt, Special Weighted Quilts for Special Kids;Order Form, dated Jul. 1, 2007, 3 pages.
Salt of the Earth Weighted Blankets, Weighted Blankets Weighted Vests & More, dated Jul. 1, 2007, 4 pages.
Salt of the Earth Weighted Blankets, Weighted Blanket Sizes and Prices, dated Jul. 1, 2007, 3 pages.
Salt of the Earth Weighted Blanket, Weighted Blanket Information, How Much Weight, What kind of Weight; Learn About Weights, dated Jul. 1, 2007, 4 pages.
Salt of the Earth Weighted Gear, Weighted Vests, dated Jul. 1, 2007, 5 pages.
Salt of the Earth Gear Weighted Weighted Blankets, Buy A Weighted Lap pad, Lap Wrap, Shoulder Wrap, dated Jul. 1, 2007, p. 3.
Salt of the Earth, Weighted Blankets, Frequently Asked Questions, dated Jul. 1, 2007, 5 pages.
Southpaw Enterprises, Sensory Processing Disorder (SPD) Sensory Integration Products, Equipment and Resource: Weights, dated Jul. 1, 2007, 4 pages.
Sircus, Mark, AC., OMD, Loss Vulnerability:Therapeutic Healing Touch, dated Jul. 1, 2007, 2 pages. AC., OMD, Loss Vulnerability:Therapeutic Healing Touch, dated Jul. 1, 2007, 2 pages.
Southpaw Enterprises, Sensory Processing Disorder (SPD) Sensory Integration Products, Equipment and Resources Weights;Weighted Hat, dated Jul. 1, 2007, 2 pages.
Walker, M.S., OTR/L, Diane B., and McCormack, Kathleen, The Weighted Blanket: An Essential Nutrient in a Sensory Diet, dated Jul. 3, 2007, 2 pages.
Weighted Vest for Children with Dysfunction of Sensory Integration(DSI) such as ADD, ADHD, Hyperactivity, or Autism, Frequently Asked Questions, copyright Jul. 2003, 6 pages.
Weighted Vest for Children with Dysfunction of Sensory Integration(DSI) such as ADD, ADHD, Hyperactivity, or Autism, What is Sensory Integration?, copryright Jul. 2003, 3 pages.

* cited by examiner

WEIGHTED ARTICLE

BACKGROUND

Deep pressure therapy has been found to be useful in the treatment of a variety of disorders where anxiety is an issue. Such disorders include developmental disorders including Autistic Spectrum Disorder, Attention-Deficit/Hyperactivity Disorder (ADHD), Pervasive Developmental Disorder Not Otherwise Specified (PDD-NOS), and Alzheimer's. Deep pressure therapy is also useful in the treatment of anxiety, insomnia, and other common problems.

Deep pressure therapy is a term sometimes used to refer to the application of pressure to a person. The therapy generates sensations in the body, such as those arising from hugging, cuddling, squeezing, stroking, or holding. One type of deep pressure therapy involves the use of a weighted blanket containing a weighted material distributed within the blanket. The blanket is placed over a part of the body and applies general pressure to that part of the body.

SUMMARY

In general terms, the present disclosure is directed to weighted articles. In one possible configuration and by non-limiting example, an embodiment relates to weighted articles for providing deep-pressure therapy for those who suffer from anxiety.

One aspect is a weighted quilt. The quilt includes a quilt top, a backing layer, and a batting layer. The quilt top includes an arrangement of patchwork pieces fastened together at edges, the patchwork pieces comprising a plurality of layers, wherein a first plurality of the patchwork pieces contain a filler of weighted material between at least two of the plurality of layers. The batting layer is between the quilt top and the backing layer. The quilt top, backing layer, and batting layer are connected together by quilting.

Another aspect is a weighted article including a first portion and a third fabric layer. The first portion includes a first fabric layer, a second fabric layer, and weighted pellets. The first fabric layer and the second fabric layer are connected together with stitching, the stitching defining sections having edges. The weighted pellets are contained between the first layer and the second layer and within the sections. The third fabric layer extends across the sections and conceals edges of the sections.

Yet another aspect is a weighted article including a first fabric layer, a second fabric layer, a first stitching pattern, weighted pellets, a second stitching pattern, and an outer fabric layer. The first stitching pattern connects the first and second fabric layers to form columns. The weighted pellets are within at least some of the plurality of columns and between the first and second fabric layers. The second stitching pattern connects the first fabric layer and second fabric layers to form a plurality of sections within the plurality of columns to contain the weighted pellets within the sections. The outer fabric layer extends across the first and second stitching patterns and is arranged to conceal at least part of the first and second stitching patterns.

A further aspect is a method of forming a weighted article. The method includes forming a plurality of patchwork pieces including a plurality of layers; inserting a filler of weighted material between at least two of the plurality of layers of at least some of the plurality of patchwork pieces; fastening edges of the plurality of layers to enclose the filler within at least some of the plurality of patchwork pieces; and connecting edges of the plurality of patchwork pieces together to form an array of patchwork pieces.

DETAILED DESCRIPTION

Figure 1:
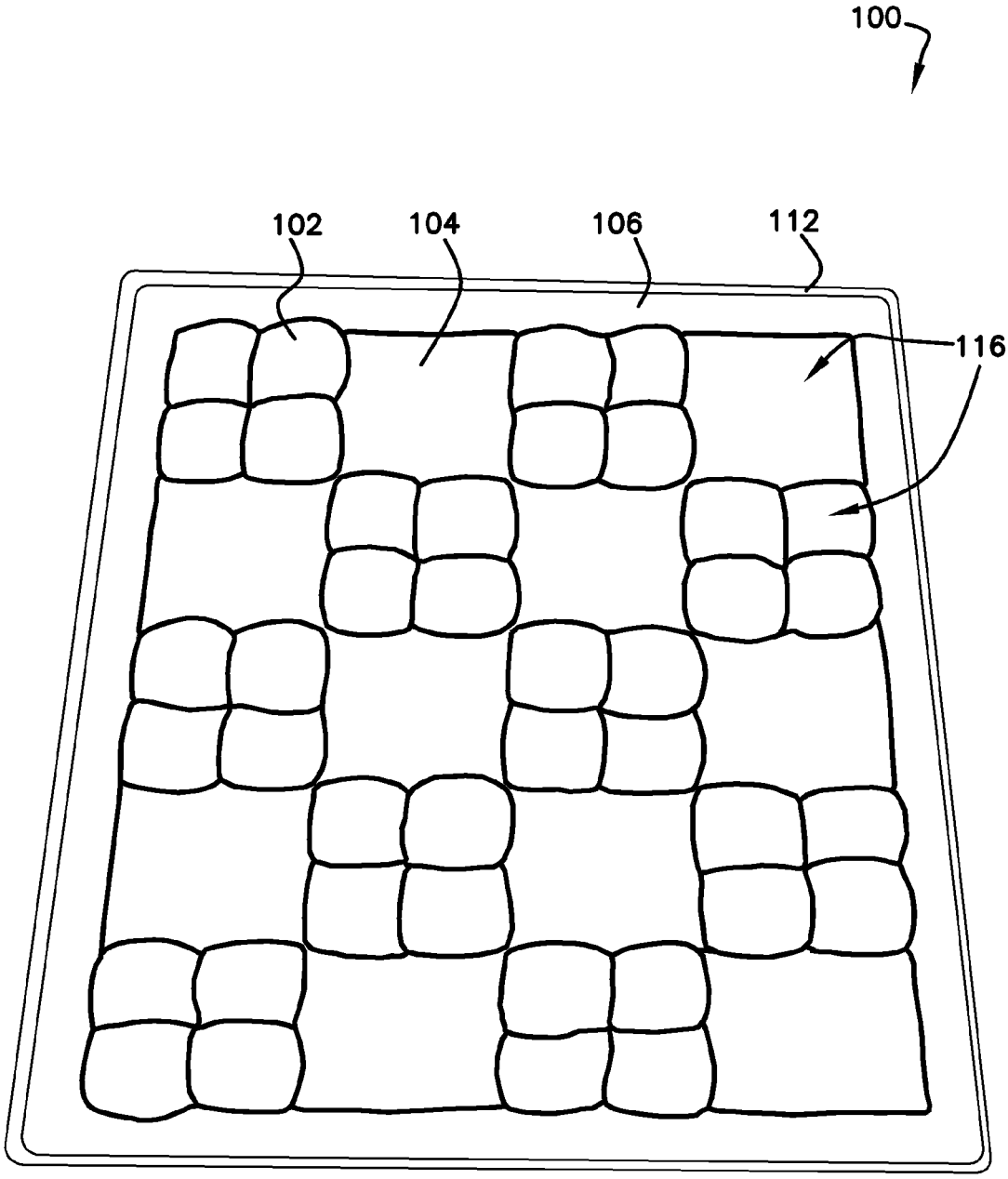
FIG. 1 is a top perspective view of an example weighted quilt according to the present disclosure.

Various embodiments will be described in detail with reference to the drawings wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Weighted blankets can be used to provide deep pressure therapy. A difficulty is that weighted blankets are often not very durable, and tend to be easily damaged over time. For example, a weighted blanket can be formed of two layers of fabric sewn together with thread to contain the weighted material within the two layers. These blankets can be damaged by a tear in the material, a broken thread, or by wear from the weighted material. Such damage can result in the spilling or displacement of the weighted material. Some weighted blankets are filled with weighted materials such as rocks or sand having sharp edges that cause damage to the fabric layers or thread. Other weighted blankets are filled with organic materials that rot or decay over time. Yet other weighted blankets are filled with porous materials that are not easily dried. As a result, washing the weighted blankets is often another difficulty.

Another shortcoming is that weighted materials do not remain evenly distributed within weighted blankets. Rather, the weighted material will often bunch or clump in an end or a side of the blanket, resulting in an uneven application of pressure. Embodiments of the present invention address these and other shortcomings.

Figure 2:
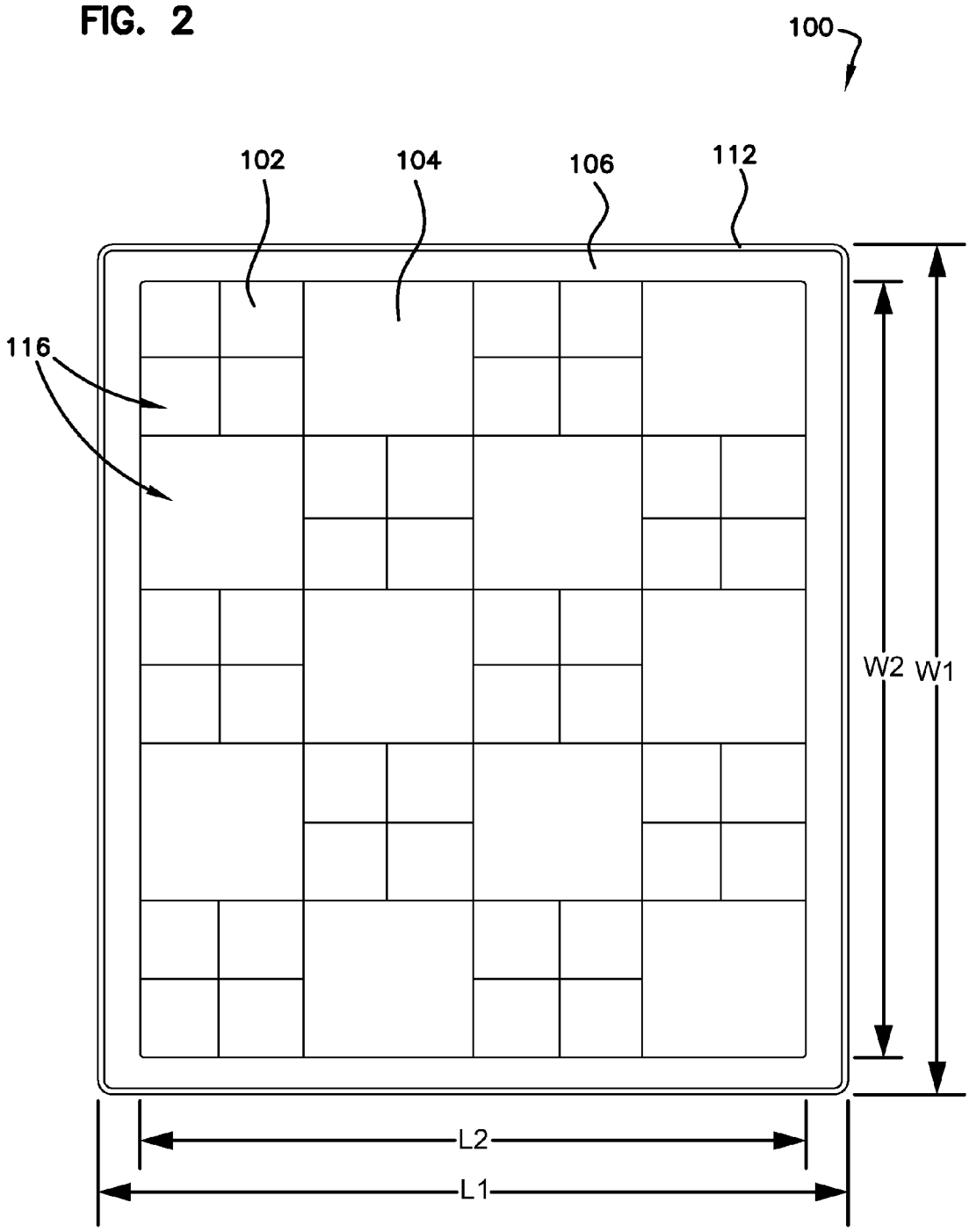
FIG. 2 is a top view of the weighted quilt shown in FIG. 1.
Figure 3:
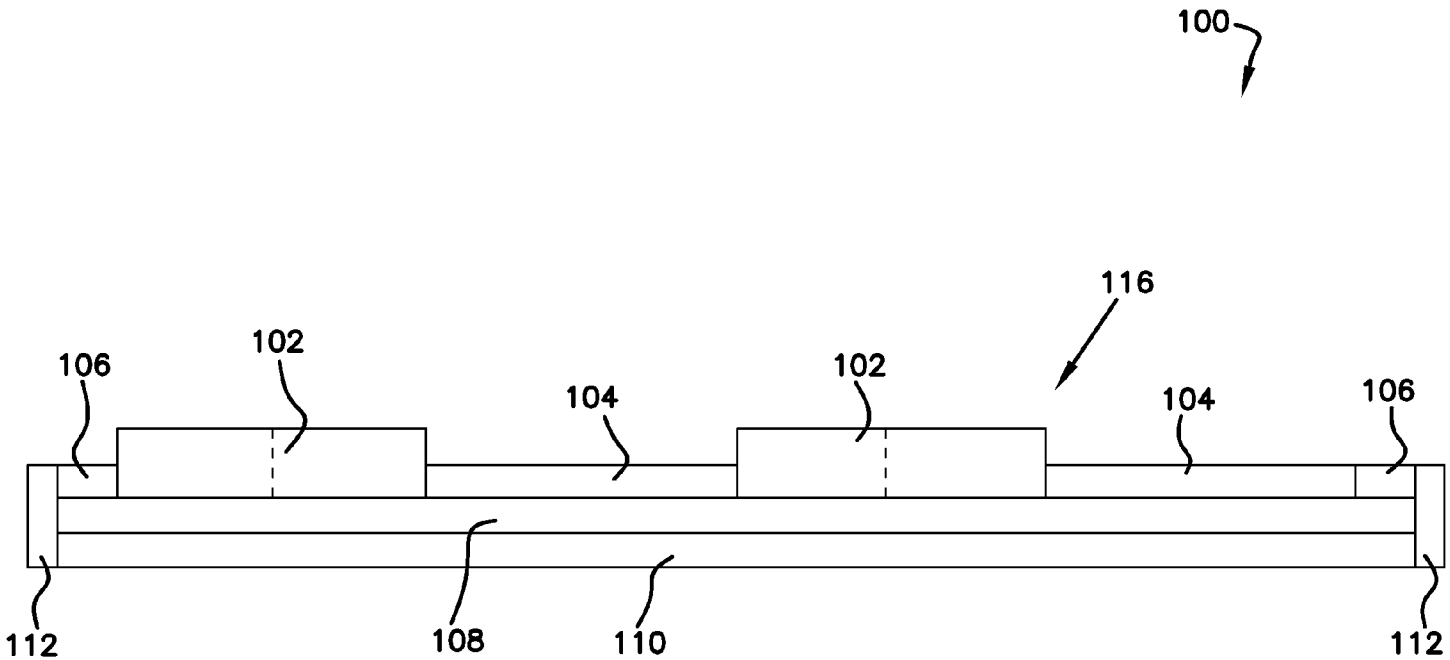
FIG. 3 is a cross-sectional block diagram of the weighted quilt shown in FIG. 1.

FIGS. 1-3 illustrate an example weighted quilt 100 that is one possible form of the weighted articles describe herein. FIG. 1 is a perspective view of weighted quilt 100. FIG. 2 is a top view of weighted quilt 100. FIG. 3 is a cross sectional block diagram of weighted quilt 100.

In this example, weighted quilt 100 includes a plurality of patchwork pieces 102 and 104, border 106, batting 108, backing 110, binding 112, and stitching 114. Patchwork pieces include weighted patchwork pieces 102 and non-weighted patchwork pieces 104. Weighted patchwork pieces 102 include a filler of weighted material, such as weighted pellets, that increase the weight of patchwork pieces 102. Patchwork pieces 104 do not include the filler of weighted material, and therefore are lighter than patchwork pieces 102.

In some embodiments, patchwork pieces 102 and 104 are generally square or rectangular, such that they have four edges. Other embodiments include any other desired shape, having more or fewer edges. The edges of the patchwork pieces 102 and 104 are arranged in a side-by-side orientation and connected together to form quilt top 116. Edges of the patchwork pieces 102 and 104 are connected, for example, by sewing together with a strand of material, such as thread. Other fasteners are used in other embodiments.

Quilt top 116 is formed from the connected patchwork pieces 102 and 104. Quilt top 116 includes edges, such as four edges in the example embodiment. A border 106 extends from and is connected to the edges. Border 106 provides a clean look to the edges of quilt top 116, but is not required in all embodiments.

Batting 108 is arranged between quilt top 116 and backing 110, such that quilt top 116 forms a top layer, batting 108 forms a middle layer, and backing 110 forms a bottom layer. Batting 108 is a material layer between backing 110 and quilt top 116. In some embodiments, batting 108 is made of wool, cotton, polyester, or other fibers or combinations of fibers. One advantage of batting 108 is that it increases the insulating properties of quilt 100. Another advantage of batting 108 is that it protects an interior side of quilt top 116 from damage, including patchwork pieces 102. Batting 108 also increases the fluffiness of quilt 100 to provide a softer and more soothing sensation.

Backing 110 is adjacent backing 108 and forms an outer surface of quilt 100, opposite quilt top 116. Backing 110 is a material or fabric layer, such as made from flannel or other materials. If desired, backing 110 can include a pattern or design for aesthetic purposes. When in use, quilt 100 is often placed such that backing 110 is against the skin or clothing of a person. As a result, it is advantageous for backing 110 to include a soft or otherwise soothing texture.

Quilt top 116, batting 108, and backing 110 are connected together, such as using thread and quilting techniques. Binding 112 is connected across edges of quilt top 116, batting 108, and backing 110 to enclose the edges and provide a clean and finished appearance to quilt 100. Binding 112 is any desired material, and in some embodiments is made from the same material as one or more of quilt top 116, border 106, and backing 110.

Although the example of quilt 100 is described as having square or rectangular patchwork pieces 102 and 104, and having a generally square or rectangular shape, other embodiments include other shapes. Other possible shapes include triangles, stars, rhombi, trapezoids, hexagons, ovals, circles, and combinations of such shapes. Other more complex shapes are used in other embodiments. Furthermore, there is no requirement that all patchwork pieces 102 and 104 be the same size, shape, color, or weight.

One exemplary application for weighted quilt 100 is to provide deep pressure therapy. The weight provided by weighted patchwork pieces 102 causes quilt 100 to apply a pressure to anything below quilt 100. For example, if placed on a portion of a person, the weight of the quilt 100 applies a pressure to the skin, causing pressure sensations to be generated within the body. These sensations are received by the brain and results in a soothing and/or calming sensation. This sensation is useful, for example, to those suffering from anxiety, and causes a reduction in anxiety. Similar advantages are realized for those having disorders such as Autistic Spectrum Disorder, Attention-Deficit/Hyperactivity Disorder (ADHD), Pervasive Developmental Disorder Not Otherwise Specified (PDD-NOS), and Alzheimer's. Deep pressure therapy is also useful in the treatment of insomnia, and other common problems.

Quilt 100 can also be advantageous to enhance a person's ability to focus and to aid a person in sitting still, and in other ways. Applications for quilt 100 are not limited to humans, and also include applications for animals and other creatures. Furthermore, other possible applications of quilt 100 are for weight training, general warmth, aesthetic decor, and other purposes.

Embodiments of weighted quilt 100 are of various sizes. Example sizes include standard sizes to match a bed, such as twin, full, queen, king, and the like. Other quilts 100 are sized to fit on a lap or as a pad for kneeling.

In various embodiments a weighted article's total weight is typically in a range from about five pounds to about thirty pounds. The overall weight of some embodiments is selected based upon the overall weight of the person that will be using it. For example, some embodiments have a weight that is selected to be in a range from about five percent to about twenty percent of the person's total weight. This range is desirable in some embodiments to provide a sufficient amount of pressure to provide advantages as described herein, while not applying too much pressure to the user. Other embodiments include an overall weight that is greater than thirty pounds, such as up to one hundred pounds or more.

In addition to weighted quilts, other weighted articles are also possible having a similar design and construction to the weighted quilt described herein. For example, some other possible weighted articles include a vest, a hat, a pair of pants, and a hooded cloak.

To further illustrate some example embodiments, dimensions are provided with reference to FIG. 2. L1 is an overall length of quilt 100. L1 is typically in a range from about 24 inches to about 120 inches, and preferably from about 35 inches to about 50 inches. L2 is the length of quilt top 100, not including border 106 or binding 112. L2 is typically in a range from about 20 to about 110 inches, and preferably from about 30 inches to about 48 inches. W1 is the overall width of quilt 100. W1 is typically in a range from about 24 inches to about 120 inches, and preferably from about 35 inches to about 50 inches. W2 is the width of quilt top 100, not including border 106 or binding 112. W2 is typically in a range from about 20 inches to about 110 inches, and preferably from about 30 inches to about 48 inches.

Figure 4:
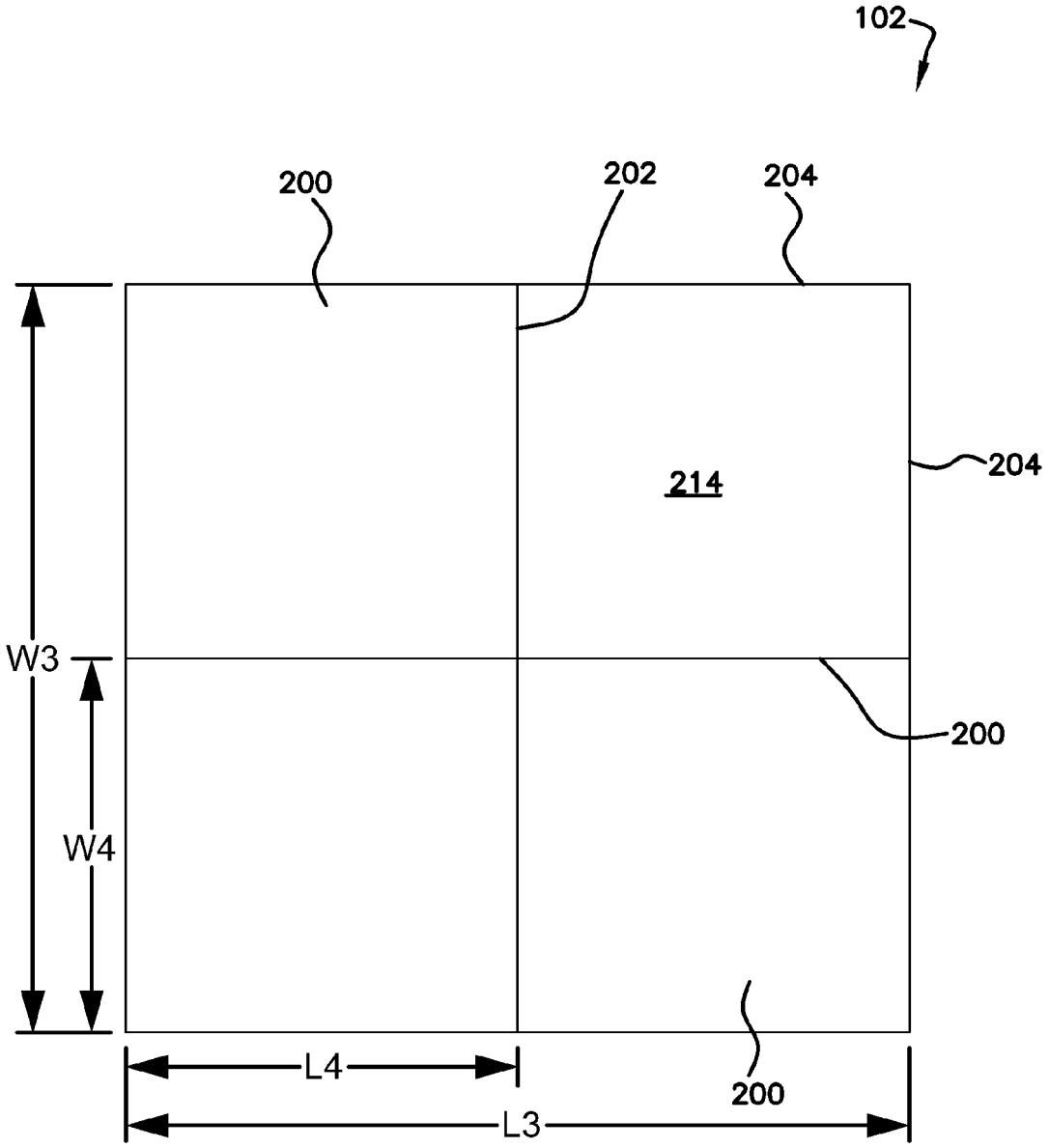
FIG. 4 is a top view of a weighted patchwork piece of the weighted quilt shown in FIG. 1.
Figure 5:
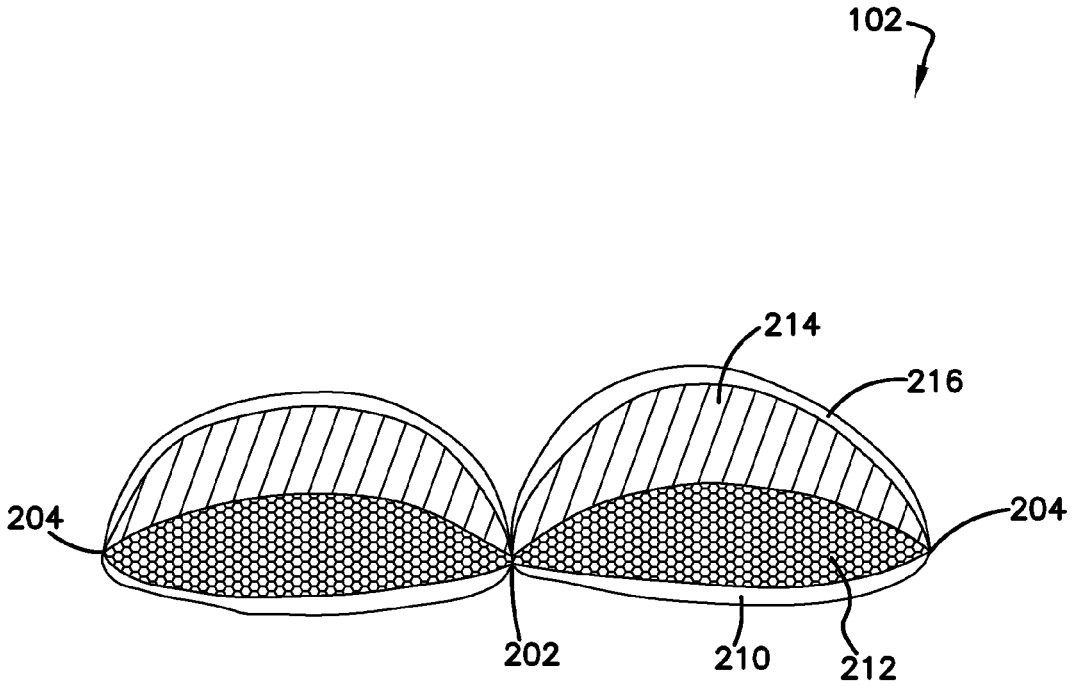
FIG. 5 is a side cross-sectional view of the weighted patchwork piece shown in FIG. 4.

FIGS. 4 and 5 illustrate an exemplary embodiment of weighted patchwork piece 102. FIG. 4 is a top view of weighted patchwork piece 102. FIG. 5 is a cross-sectional view of weighted patchwork piece 102. As shown in FIG. 5, weighted patchwork piece 102 includes bottom layer 210, weighted filler 212, inner layer 214, and top layer 216.

Referring to FIGS. 4 and 5, weighted patchwork piece 102 includes weighted filler 212 that causes weighted patchwork piece 102 to be heavier than non-weighted patchwork pieces 104. Weighted filler is confined within layers of weighted patchwork piece 200 by seams formed at edges 204 of the weighted patchwork piece 102. For example, thread can be used to sew layers 210, 214, and 216 together at edges 204. By confining weighted filler 212 within weighted patchwork pieces 102, weighted quilt 100 prevents weighted filler 212 from clumping at a corner or end of weighted quilt 100, and maintains the desired distribution of weighted filler throughout weighted quilt 100.

Weighted patchwork piece 102 is further segmented into subsections 200 by seams 202. Seam 202 is, for example, a seam made from thread sewn through layers 210, 214, and 216. The seam pulls the layers tightly together and prevents weighted filler 212 from passing from one subsection to another. As a result, seams 202 act to further maintain the desired distribution of weighted filler, by confining the weighted filler within subsections 214 of weighted patchwork piece 102. In the illustrated embodiment, weighted patchwork piece 102 is divided into four subsections. In other embodiments, weighted patchwork piece 102 includes two or more subsections.

Example dimensions for the illustrated embodiment of weighted patchwork piece 102 are shown in FIG. 4. L3 is the overall length of weighted patchwork piece 102. L3 is typically in a range from about one inch to about twenty inches, and preferably from about three inches to about nine inches. L4 is the length of subsection 110. L4 typically ranges from about a half inch to about five inches, and preferably from about two inches to about 4 inches. W3 is the overall width of weighted patchwork piece 102. W3 is typically in a range from about one inch to about twenty inches, and preferably from about three inch to about nine inches. W4 is the width of subsection 110. W4 is typically in a range from about a half inch to about five inches, and preferably from about two inches to about 4 inches.

FIG. 5 illustrates a cross-sectional view of weighted patchwork piece 102, including bottom layer 210, weighted filler 212, inner layer 214, top layer 216, and seams 202 and 204. Bottom layer 210 is a layer of material that is arranged adjacent to batting 108 of assembled quilt 100 (shown in FIG. 3), and is therefore located internal to quilt 100. In one embodiment, bottom layer 210 is a fabric layer, such as flannel, although other known fabrics can also be used. Bottom layer 210 operates to contain the weighted pellets, such that they do not pass out of the bottom side of weighted patchwork piece 102.

Weighted filler 212 is contained between bottom layer 210 and inner layer 214. In some embodiments weighted filler 212 includes plastic pellets. One example of suitable plastic pellets is POLY-PELLET® plastic pellets manufactured by Fairfield Processing Corporation of Danbury, Conn. One of the advantages of plastic pellets is that they are machine washable and do not degrade over time. Another advantage of plastic pellets is that they can be made to be free of sharp or rough edges. This reduces the wear on layers 210, 214, and 216 and seams 202 and 204 of weighted patchwork piece 102, thereby increasing the longevity of the quilt.

Other possible weighted fillers 212 include sand, rocks, pebbles, metal pieces, a liquid-filled bladder, wood chips, dried rice, dried peas, rubber pieces, and other weighting materials. In another embodiment, a dense fabric or fabric-like material could also be used.

The weight of weighted patchwork pieces 102 and the overall quilt is variable depending on the amount of weighted filler 212 placed within each weighted patchwork piece 102, and more specifically, within each subsection 200. The volume of materials will vary depending also on the weight of the particular weighted filler used.

As one example, a weighted patchwork piece 102 typically includes a volume of plastic pellets in a range from about one-half cup to about five cups in volume. Some embodiments include a volume of plastic pellets in a range from about one-eighth cup to about one-half cup per section. In an embodiment having four sections per weighted patchwork piece 102, the overall weight of the weighted patchwork piece is in a range from about one-quarter pound to about one-half pound per weighted patchwork piece. In some embodiments, a density of weighted filler is in a range from about one-quarter pound per cup to about one-half pound per cup.

Inner layer 214 is adjacent to weighted filler 212. In some embodiments, inner layer 214 is batting, which provides a layer of wear protection between the weighted filler 212 and top layer 216. Inner layer 214 also provides additional thickness, softness, and padding to weighted patchwork piece 102, in some embodiments.

Top layer 216 is an outer layer, such as a fabric layer. In some embodiments, top layer 216 is made of flannel. Other known fabrics can also be used in other embodiments. The color and pattern selected for top layer 216 can further increase the ability of the weighted quilt to reduce anxiety. For example, in some embodiments, top layer 216 is made from a material having a violet, blue, and/or green color. More specifically, the fabric color can be selected to reflect light within the visible spectrum having a wavelength of less than 570 nanometers in wavelength. Other embodiments can be made to have any desired colors or combinations of colors.

Although a specific embodiment of weighted patchwork piece 102 is shown and described, it is recognized that other embodiments of weighted patchwork piece 102 will include different features. For example, additional layers are included in some embodiments.

Figure 6:
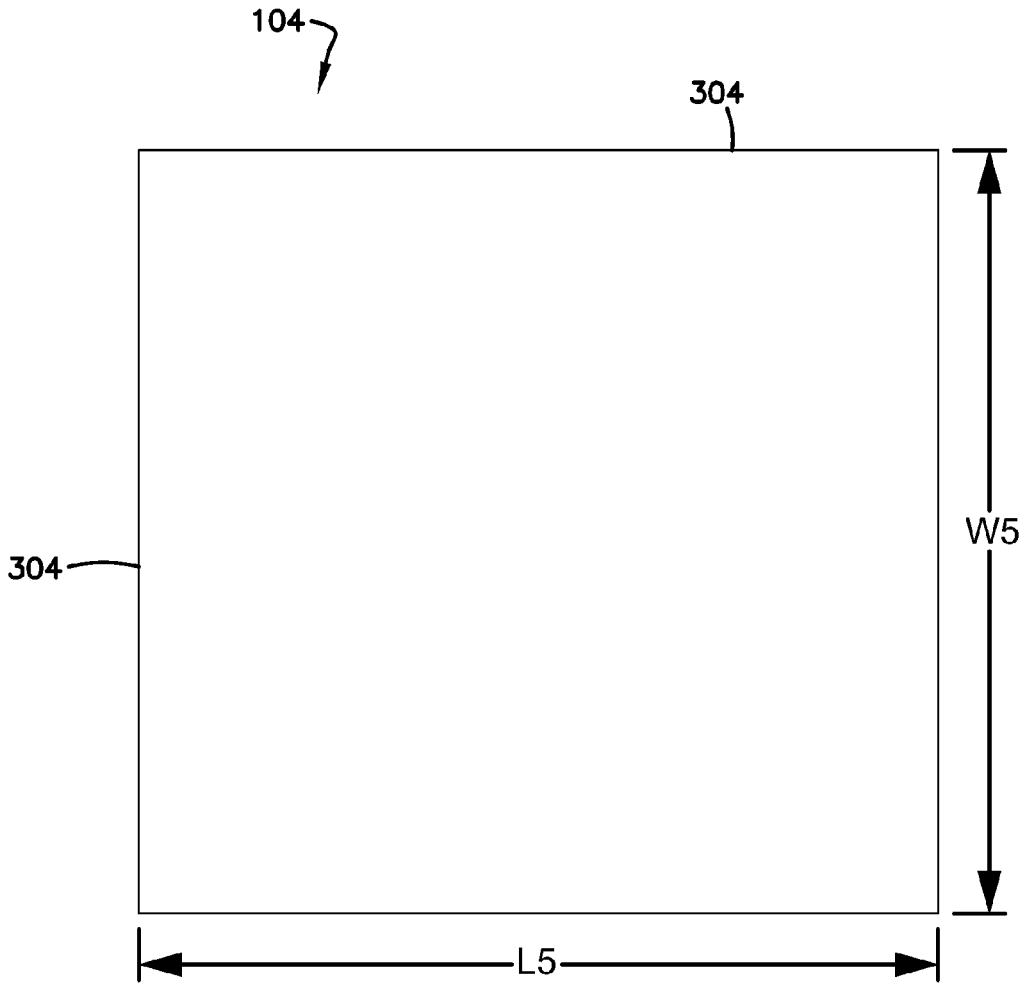
FIG. 6 is a top view of a non-weighted patchwork piece of the weighted quilt shown in FIG. 1.
Figure 7:
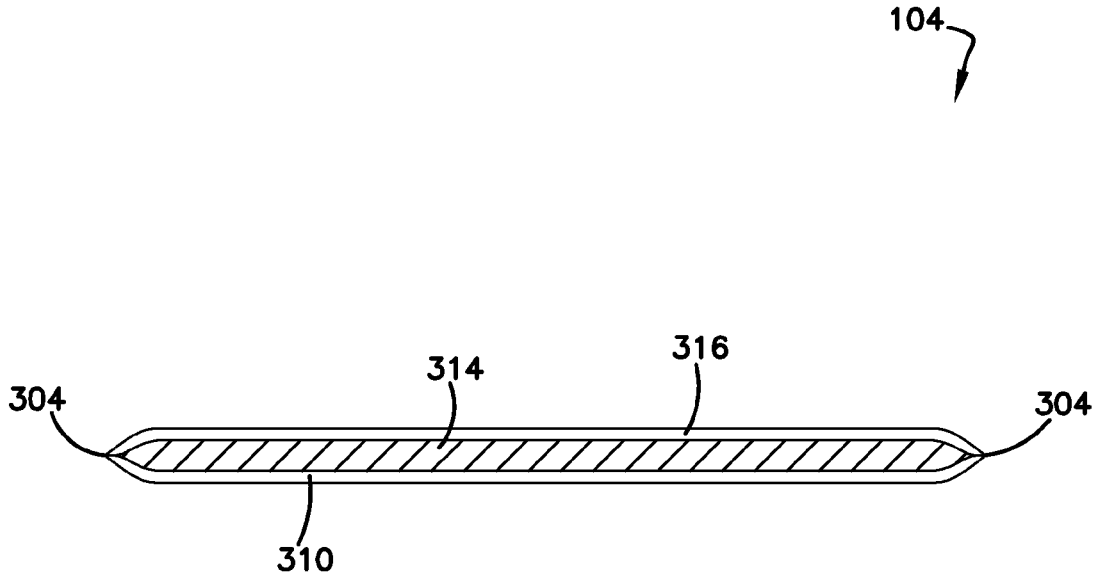
FIG. 7 is a side cross-sectional view of the non-weighted patchwork piece shown in FIG. 6.

FIGS. 6-7 illustrate an exemplary embodiment of non-weighted patchwork piece 104. FIG. 6 is a top view. FIG. 7 is a side cross-sectional view. As shown in FIG. 7, non-weighted patchwork piece 104 includes bottom layer 310, inner layer 314, and top layer 316.

Referring to FIGS. 6 and 7, non-weighted patchwork piece 104 does not include weighted filler, and as a result is lighter than weighted patchwork piece 102 (e.g., shown in FIG. 4). Bottom layer 310 and top layer 316 are fabric layers, such as flannel or other desired materials. Inner layer 314 is a padding layer, such as batting, which increases the softness, padding, and thickness of non-weighted patchwork piece 104.

Non-weighted patchwork piece 104 includes edges 304. Edges 304 are typically cut from larger materials, and the layers arranged to align at edges 304. Edges 304 are sewn together to form a seam that connects layers 310, 314, and 316 together. The seam also encloses non-weighted patchwork piece 104 at edges 304. Non-weighted patchwork piece 104 is separate and distinct from other weighted and non-weighted patchwork pieces prior to assembly into a quilt top.

Example dimensions for the illustrated embodiment of non-weighted patchwork piece 102 are shown in FIG. 6. L6 is the overall length of non-weighted patchwork piece 104. L7 is typically in a range from about one inch to about twenty inches, and preferably from about three inches to about nine inches. W5 is the overall width of non-weighted patchwork piece 104. W5 is typically in a range from about one inch to about twenty inches, and preferably from about three inches to about nine inches.

Figure 8:
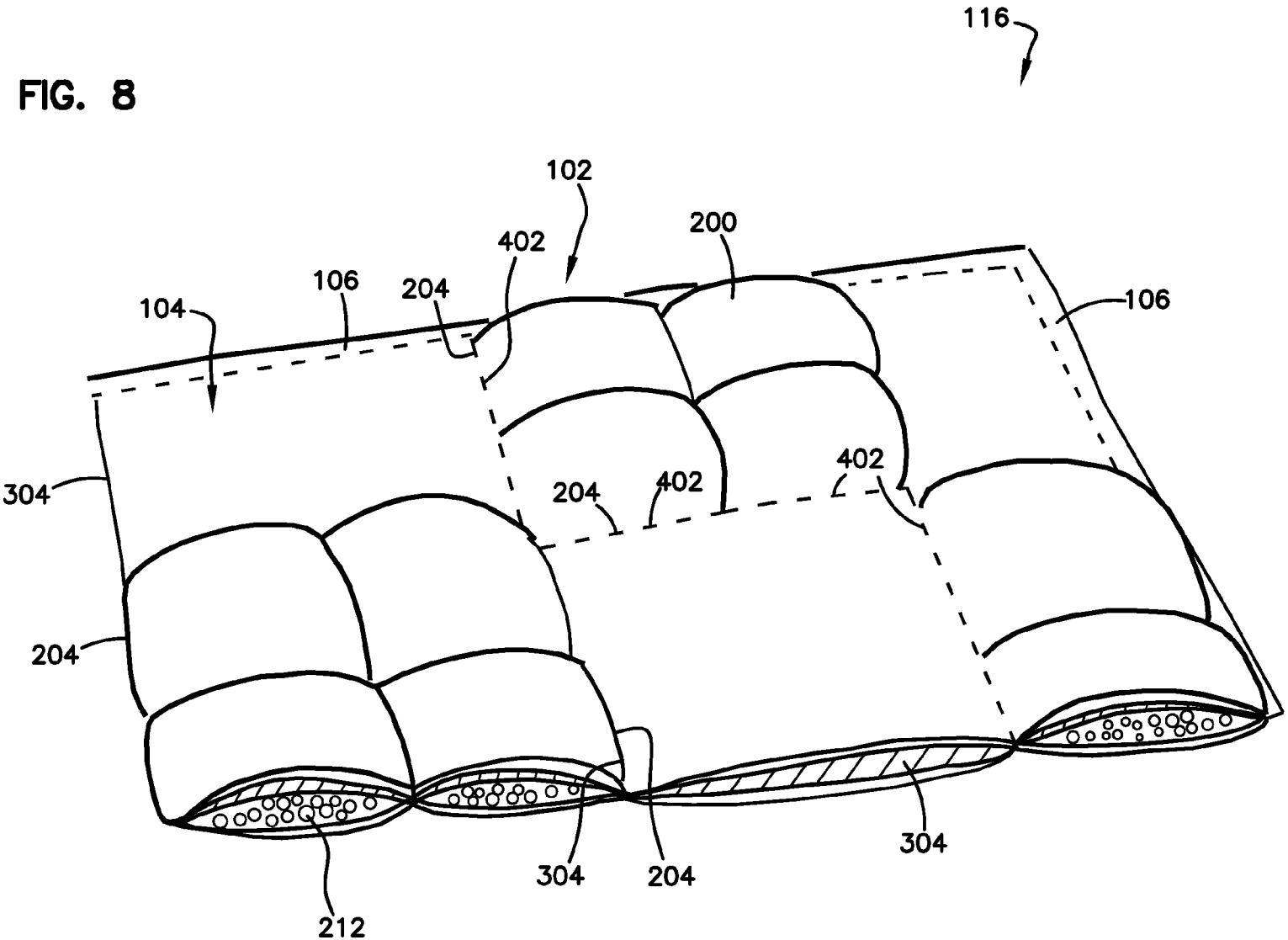
FIG. 8 is a perspective and cross-sectional view of a portion of a quilt top of the weighted quilt shown in FIG. 1.

FIG. 8 is a perspective and cross-sectional view of exemplary quilt top 116. Quilt top 116 includes weighted patchwork pieces 102, non-weighted patchwork pieces 104, and border 106.

In some embodiments, quilt top 116 is made by arranging weighted patchwork pieces 102 and non-weighted patchwork pieces 104 into a desired arrangement. For example, an alternating pattern of weighted and non-weighted patchwork pieces is used in some embodiments, such as shown in FIG. 8. In other embodiments, another regular and repeating arrangement is used. Weighted patchwork pieces 102 can be arranged adjacent to other weighted patchwork pieces, and non-weighted patchwork pieces can be arranged adjacent to non-weighted patchwork pieces, if desired. Any desired arrangement of patchwork pieces is another possible embodiment.

Weighted patchwork pieces 102 and non-weighted patchwork pieces 104 are connected together at edges 204 and 304, such as by sewing the edges together with thread to form seams 402. Seams 402 increase the durability of patchwork pieces 102 and 104 by providing a second seam at edges of patchwork pieces 102 and 104. Other embodiments include other fastening methods and materials. After pieces 102 and 104 have been connected, border 106 is optionally fastened to the outer edges of weighted and non-weighted patchwork pieces 102 and 104, such as by sewing, to form outer edges of quilt top 116. Border 106 provides a clean and finished look to the edges of quilt top 116.

Figure 9:
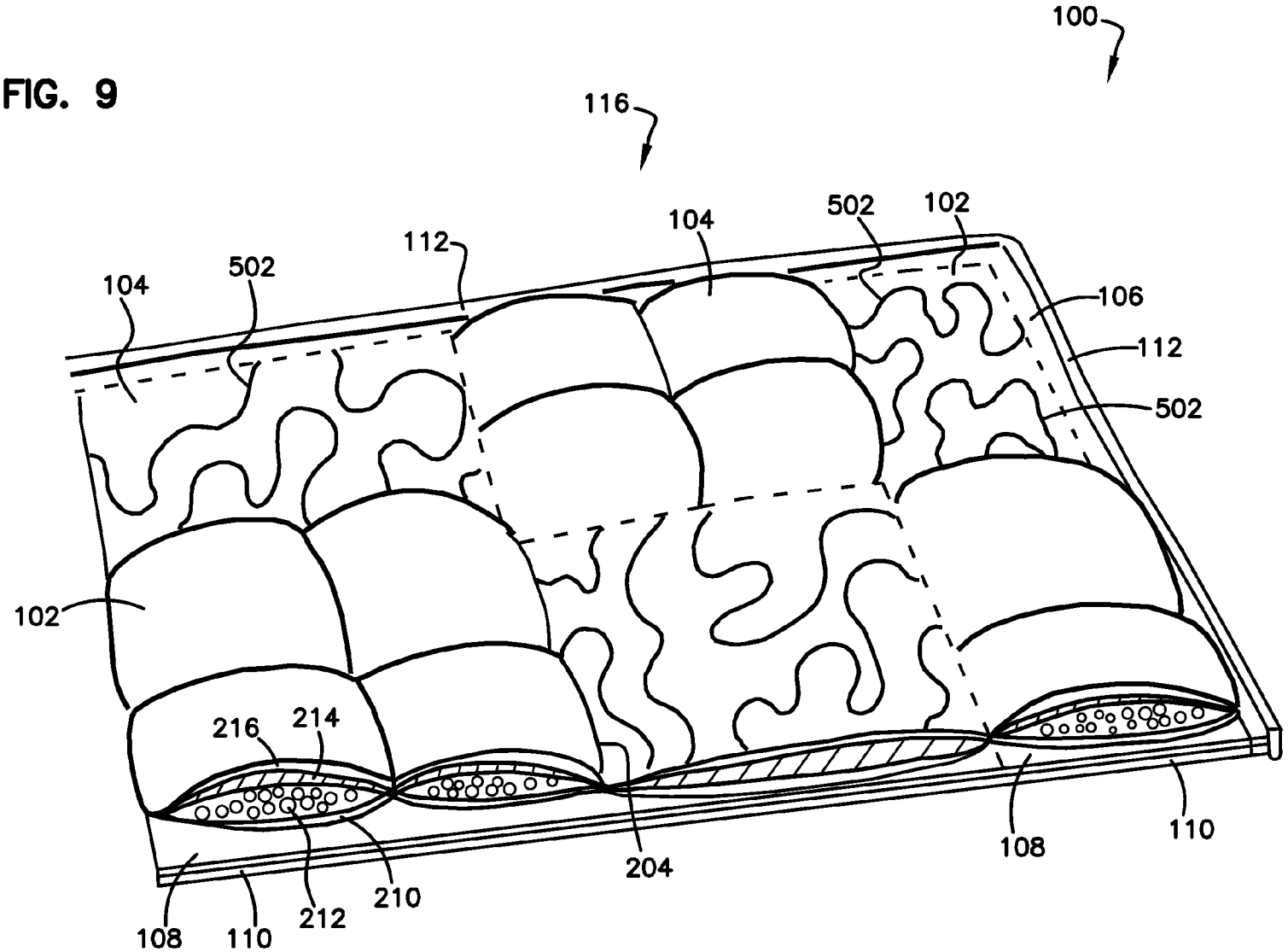
FIG. 9 is a perspective and cross-sectional view of a portion of the weighted quilt shown in FIG. 1.

FIG. 9 is a perspective and cross-sectional view of quilt 100 including quilt top 116, batting 108, and backing 110. Quilt 100 is formed by combining quilt top 116 with additional layers. In the illustrated example, batting 108 is arranged between quilt top 116 and backing 110. Quilt top 116 is then fastened to batting 108 and backing 110 by quilting 502. Quilting 502 is done, for example, with a long arm sewing machine, although other sewing or quilting techniques can also be used. Quilting 502 can be done in any desired pattern. In this embodiment, quilting 502 is done in non-weighted patchwork pieces. Quilting 502 provides further strength to quilt 100, to connect layers of quilt 100 (e.g., quilt top 116, backing 108, and batting 110) together.

Quilt 100 also includes binding 112 at edges of quilt 100. Binding 112 is a fabric or other material that is fastened, such as by stitching with thread, at edges of quilt 100. Binding 112 encloses edges of quilt 100, and is fastened to border 112 of quilt top 116, and to batting 108, and backing 110. This provides added strength to edges of quilt 100. In addition, binding 112 gives quilt 100 a clean and finished appearance.

Other embodiments include additional features from those described above. For example, some weighted articles include other sensory stimulation, such as by including an electronic vibrator, a sound generator, a heat source, a light generator, a fragrance source, or other devices for stimulating or soothing. For example, some embodiments include a pocket for insertion or removal of a sensory device. Other sensory devices are built into one or more sections of quilt 100, such as into one or more non-weighted patchwork pieces 104. Sensory devices can be powered by a battery, or an electric cord can be provided for plugging into a wall socket. Examples of sound generators include music players (such as an MP3 player, radio, CD-player, and the like), or other digital or audio sound generators typically including a speaker or headset. Examples of heat sources include heating elements, such as used in electric blankets, or pockets for holding hot water bottles.

An advantage of some embodiments of weighted quilt 100 is illustrated in FIG. 9. Weighted filler 212 is securely contained within weighted patchwork pieces 102. In some embodiments, at least two layers are provided on either side of weighted filler 212 for increased durability. For example, batting 214 and layer 216 are arranged on one side of weighted filler 212 and layer 210, batting 108, and backing 110 are arranged on the other side of weighted filler 212. In some embodiments the durability is increased because the two or more layers resist wear, tears, punctures, and the like. Even if one layer becomes damaged, a second layer remains to contain weighted filler 212. In other embodiments, durability is increased because at least one layer of batting is included on either side of weighted filler 212. For example, batting 214 is arranged on one side of weighted filler 212, and batting 108 is arranged on another side of weighted filler 212. Batting 214 increases the durability of some embodiments by providing a padding layer between weighted filler 212 and outer fabric layers (e.g., 216 and 110).

Some embodiments are also strengthened by the presence of at least two stitching layers around outer edges of weighted patchwork pieces 102. For example, a first stitching pattern is formed to enclose edges 204. A second stitching pattern is formed to connect edges 204 to adjacent patchwork pieces 102 or 104. However, the second stitching pattern also acts to reinforce edges 204 to increase the durability of weighted patchwork pieces 102. In some embodiments, the multiple stitching patterns act together to preventing displacement of weighted filler 212 outside of weighted patchwork piece 102.

Figure 10:
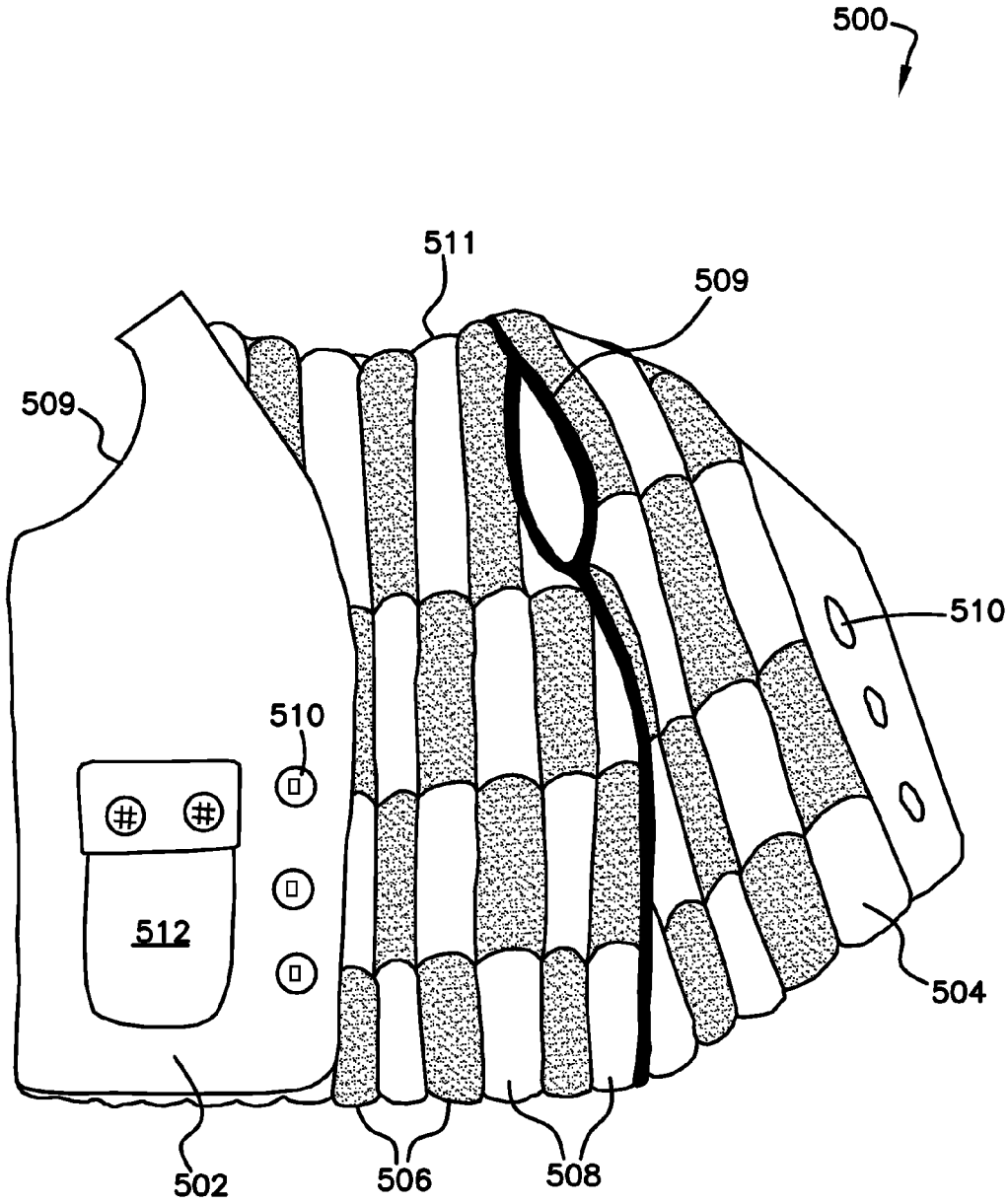
FIG. 10 is a front view of an exemplary weighted vest including patchwork pieces.

FIG. 10 is a front view of an exemplary weighted article in the form of a weighted vest 500. Weighted vest 500 includes an exterior side 502 and an interior side 504. Weighted vest 500 includes weighted patchwork pieces 506 and non-weighted patchwork pieces 508. A left side of weighted vest 500 is shown in FIG. 10 in a flipped-open position to reveal interior side 504. Weighted vest 500 is sized to be worn by a person.

Weighted vest 500 demonstrates just one example of another type of weighted article, other than a weighted quilt. Other embodiments include other types of weighted articles, such as weighted pants, a weighted jacket, a hooded sweatshirt, a weighted hat, and other types of weighted articles.

In some embodiments, weighted vest 500 is made in a similar manner as weighted quilt 100. Interior side 504 includes weighted patchwork pieces 506 and non-weighted patchwork pieces 508 arranged in any desired pattern, such as in an alternating arrangement. The edges are fastened together, such as by sewing, leaving spaces for arm holes 509, a neck opening 511, and the like. In this embodiment, weighted patchwork pieces 506 do not include subsections, but subsections are used in other embodiments to reduce bunching and clumping of weighted filler.

Exterior side 502 is fastened at edges to interior side 504. In some embodiments, exterior side 502 is a fabric layer (similar to backing 110, of quilt 100). One of the advantages of exterior side 502 is that it conceals the presence of weighted patchwork pieces 506. It is sometimes desirable to conceal the presence of weighted patchwork pieces 506, such that vest 100 appears to be an ordinary non-weighted vest. It is therefore preferred that exterior side 502 not be fastened at the intersections between each patchwork piece 506 and 508, but rather only along some of the edges of vest 500. If desired for further insulation or padding, or to further conceal the presence of weighted patchwork pieces 506, a batting layer (such as 108, shown in FIG. 9) can be arranged between exterior side 502 and interior side 504.

Weighted vest 500 includes one or more fasteners 510 for closing vest 500. Suitable fasteners 510 include buttons and button holes, zippers, hook and loop fasteners, snaps, and the like. Another embodiments of vest 500 is a pull-over, such that fasteners are not required.

Weighted vest 500 also includes pocket 512. In some embodiments, a sensory device is stored within pocket 512. Other embodiments do not include pocket 512.

Figure 11:
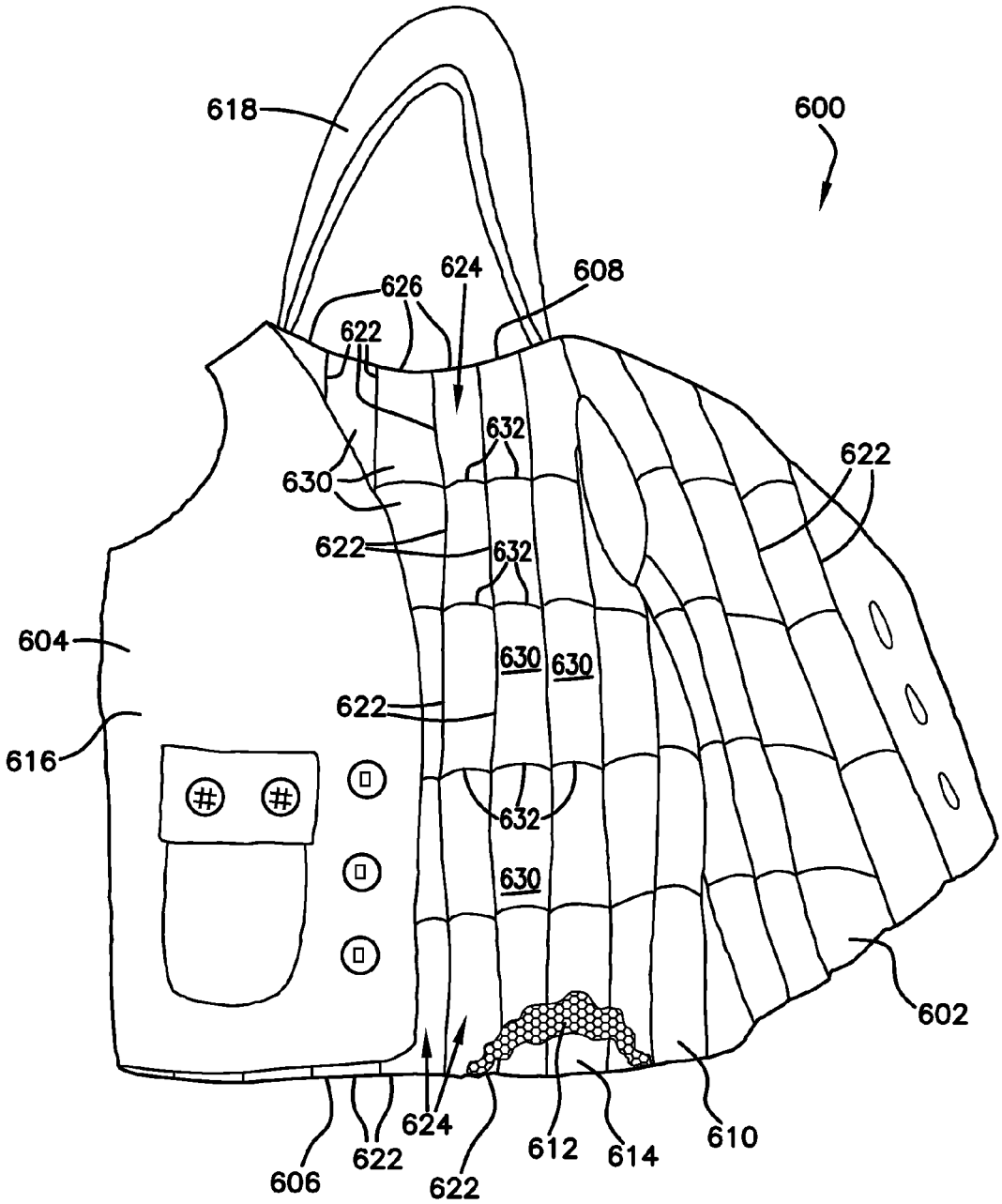
FIG. 11 is a front view of another exemplary weighted vest.

FIG. 11 is another exemplary embodiment of weighted vest 600. Weighted vest 600 includes interior side 602, exterior side 604, bottom side 606, and top side 608. A section of weighted vest 600 is cut away to reveal portions of weighted vest 600. In this embodiment, weighted vest 600 is not formed of patchwork pieces. Weighted vest 600 includes layer 610, weighted filler 612, layer 614, and layer 616. Vest 600 also includes optional hood 618 fastened to top side 608.

Interior side 602 of weighted vest 600 is formed of layer 610, weighted filler 612, and layer 614. In some embodiments, additional layers are also included, such as one or more batting layers. Layers 610 and 614 are fabric layers, such as flannel, muslin, or other desired fabrics. To make interior side 602 or weighted vest 600, layers 610 and 614 are arranged against each other, and seams 620 and 622 are sewn into layers 610 and 614 to form columns 624 that extend from top side 608 to bottom side 606. When vest 100 is worn on a person, seams 620 and columns 624 extend generally vertically, and seams 622 extend generally horizontally between seams 620 at bottom 606. In this way, long open columns are formed having openings at top 608. In another embodiment, seams 620 are instead formed at top 606, such that the openings are at bottom 606.

After columns 624 have been formed, they are filled with weighted filler 612. Examples of suitable weighted filler are described above. Columns 624 are then closed, such as by sewing seams 626. In this way, layers 610 and 614 are connected together to enclose weighted filler 612 between layers 610 and 614 along columns 614. Columns 614 prevent weighted filler 612 from moving sideways in weighted vest 600, such as preventing weighted filler 612 from entering the space of an adjacent column.

Columns 614 are then subdivided into sections 630. In one embodiment, sections 630 are formed in columns 614 by sewing seams 632 across columns 614 to connect layers 610 and 614 together. Each column 614 is divided into two or more sections. Sections 630 prevent at least some of the weighted filler 612 from bunching and clumping at bottom side 606 of columns 614. Rather, seams 632 maintain the desired distribution of weighted filler 612 along columns 624.

Outer layer 616 is fastened to inner side 602. Outer layer 616 is made of fabric or other desired material. Outer layer 616 is fastened to inner side 602, such as by sewing at edges. In some embodiments, outer layer 616 provides an added layer of protection to sections 630, such as from wear, puncture, or other damage. In other embodiments, outer layer 616 conceals weighted sections 630, such as to give vest 600 the appearance of being a non-weighted vest. Additional layers are included in some embodiments, such as a batting or other insulating material for padding, warmth, and added concealment of weighted sections 630.

Some embodiments of weighted vest 600 include hood 618. In addition to providing added warmth, hood 618 also reduces visual stimulation by blocking some or all of the user's peripheral vision when warn. This reduction in visual stimulation will further reduce anxiety in some users.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A weighted quilt comprising:

(a) a quilt top comprising an arrangement of patchwork pieces fastened together at edges of the patchwork pieces, the patchwork pieces comprising a plurality of layers, wherein a first plurality of the patchwork pieces contain a filler of weighted material between at least two of the plurality of layers, and a second plurality of patchwork pieces are free of the filler of weighted material, the second plurality of patchwork pieces being arranged in a repeating pattern with the first plurality of patchwork pieces;

(b) a backing layer; and (c) a batting layer between the quilt top and the backing layer, wherein the quilt top, backing layer, and batting layer are connected together by quilting.

2. The weighted quilt of claim 1, wherein the first plurality of patchwork pieces containing the filler are heavier than the second plurality of patchwork pieces that do not contain the filler.

3. The weighted quilt of claim 1, further comprising a border fastened around the quilt top.

4. The weighted quilt of claim 3, further comprising a binding connected to the border and the backing to form an edge of the weighted quilt.

5. The weighted quilt of claim 1, the plurality of layers further comprising an outer fabric layer, a muslin layer, and a second batting layer between the fabric layer and the muslin layer, and wherein the weighted filler is arranged between the muslin layer and the batting layer.

6. The weighted quilt of claim 1, wherein the first plurality of patchwork pieces further comprise subsections for containing the filler of weighted material within the subsections.

7. The weighted quilt of claim 1, wherein the filler of weighted material comprises plastic pellets.

8. The weighted quilt of claim 1, wherein the filler of weighted material has a density greater than a density of any of the plurality of layers.

9. The weighted quilt of claim 1, wherein a weight of the weighted quilt is between about five pounds and about twenty pounds.

10. The weighted quilt of claim 1, wherein edges of the weighted patchwork pieces include a first stitching pattern and a second stitching pattern, the first stitching pattern forming a seam to enclose edges of the weighted patchwork piece, and the second stitching pattern enclosing edges of the weighted patchwork piece and fastening the weighted patchwork pieces to adjacent materials.

11. A weighted article comprising:

a first fabric layer;

a second fabric layer;

a first stitching pattern connecting the first and second fabric layers to form columns;

weighted plastic pellets within at least some of the plurality of columns and between the first and second fabric layers;

a second stitching pattern connecting the first fabric layer to the second fabric layer to form a plurality of sections within the plurality of columns, wherein the plurality of sections include a first plurality of sections that contain the weighted plastic pellets, and a second plurality of sections that are free of the filler of weighted material, wherein the first and second sections are arranged in a repeating pattern; and an outer fabric layer extending across the first and second stitching patterns and arranged to conceal at least part of the first and second stitching patterns.

12. The weighted article of claim 11, wherein the first and second fabric layers are arranged to define arm holes and a neck opening, and wherein the weighted article further comprising a hood extending from adjacent the neck opening, wherein the hood is arranged to reduce visual stimulation when worn.

13. A weighted quilt comprising:

(a) a quilt top comprising an arrangement of patchwork pieces fastened together at edges of the patchwork pieces, the patchwork pieces comprising a plurality of layers, wherein a first plurality of the patchwork pieces contain a filler of weighted material comprising plastic pellets between at least two of the plurality of layers;

(b) a backing layer; and (c) a batting layer between the quilt top and the backing layer, wherein the quilt top, backing layer, and batting layer are connected together by quilting.

14. The weighted quilt of claim 13, wherein the first plurality of patchwork pieces containing the filler are heavier than the second plurality of patchwork pieces that do not contain the filler.

15. The weighted quilt of claim 13, further comprising a border fastened around the quilt top.

16. The weighted quilt of claim 15, further comprising a binding connected to the border and the backing to form an edge of the weighted quilt.

17. The weighted quilt of claim 13, the plurality of layers further comprising an outer fabric layer, a muslin layer, and a second batting layer between the fabric layer and the muslin layer, and wherein the weighted filler is arranged between the muslin layer and the batting layer.

18. The weighted quilt of claim 13, wherein the first plurality of patchwork pieces further comprise subsections for containing the filler of weighted material within the subsections.

19. The weighted quilt of claim 13, wherein edges of the weighted patchwork pieces include a first stitching pattern and a second stitching pattern, the first stitching pattern forming a seam to enclose edges of the weighted patchwork piece, and the second stitching pattern enclosing edges of the weighted patchwork piece and fastening the weighted patchwork pieces to adjacent materials.

20. A weighted quilt comprising:

(a) a quilt top comprising an arrangement of patchwork pieces fastened together at edges of the patchwork pieces, the patchwork pieces comprising a plurality of layers, wherein a first plurality of the patchwork pieces contain a filler of weighted material between at least two of the plurality of layers, and wherein edges of the weighted patchwork pieces include a first stitching pattern and a second stitching pattern, the first stitching pattern forming a seam to enclose edges of the weighted patchwork piece, and the second stitching pattern enclosing edges of the weighted patchwork piece and fastening the weighted patchwork pieces to adjacent materials;

(b) a backing layer; and (c) a batting layer between the quilt top and the backing layer, wherein the quilt top, backing layer, and batting layer are connected together by quilting.

21. The weighted quilt of claim 20, further comprising a second plurality of patchwork pieces that are free of the filler of weighted material, the second plurality of patchwork pieces being arranged in a repeating pattern with the first plurality of patchwork pieces, and further comprising a border fastened around the quilt top.

22. The weighted quilt of claim 21, further comprising a binding connected to the border and the backing to form an edge of the weighted quilt.

23. The weighted quilt of claim 21, the plurality of layers further comprising an outer fabric layer, a muslin layer, and a second batting layer between the fabric layer and the muslin layer, and wherein the weighted filler is arranged between the muslin layer and the batting layer.

24. The weighted quilt of claim 20, wherein the first plurality of patchwork pieces further comprise subsections for containing the filler of weighted material within the subsections.

* * * * *